US006159081A

United States Patent [19]

Hakomori

[11] Patent Number: 6,159,081

[45] Date of Patent: Dec. 12, 2000

[54] METHOD AND APPARATUS FOR MIRROR-POLISHING OF WORKPIECE EDGES

[76] Inventor: Shunji Hakomori, 2647, Hayakawa, Ayase-shi, Japan

[21] Appl. No.: 09/148,609

[22] Filed: Sep. 4, 1998

[30] Foreign Application Priority Data

Sep. 9, 1997 [JP] Japan ..... 9-260917

[51] Int. Cl.[7] ..... B24B 1/00

[52] U.S. Cl. ..... 451/57; 451/43; 451/44; 451/65

[58] Field of Search ..... 451/41, 42, 43, 451/44, 57, 58, 65, 177, 178, 194, 195, 209, 210, 63, 59, 60

[56] References Cited

U.S. PATENT DOCUMENTS

| | | | |
|---|---|---|---|
| 5,040,342 | 8/1991 | McGuire et al. | 451/44 |
| 5,094,037 | 3/1992 | Hakomori et al. | 451/43 |
| 5,097,630 | 3/1992 | Maeda et al. | 451/194 |
| 5,117,590 | 6/1992 | Kudo et al. | 451/44 |
| 5,514,025 | 5/1996 | Hasegawa et al. | 451/44 |
| 5,658,189 | 8/1997 | Kagamida | 451/44 |
| 5,674,110 | 10/1997 | Cuoghi | 451/44 |

FOREIGN PATENT DOCUMENTS

| | | |
|---|---|---|
| 64-71656 | 3/1989 | Japan . |
| 1-274958 | 11/1989 | Japan . |
| 3-208550 | 9/1991 | Japan . |
| 7-314304 | 12/1995 | Japan . |

*Primary Examiner*—Derris H. Banks
*Attorney, Agent, or Firm*—Snell & Wilmer, L.L.P.

[57] ABSTRACT

Two cylindrical polishing drums 2 and 2, each having a polishing work surface 2*a* on their outer circumference, are disposed at an interval smaller than the diameter of a workpiece 7. The polishing drums 2 and 2 are rotated at a required speed, and a chamfered edge 7*a* of the outer circumference of the workpiece held by a workpiece holding means 3*a* is pressed against both polishing drums at the same time to mirror-polish the edge 7*a* at two different points.

15 Claims, 5 Drawing Sheets

METHOD AND APPARATUS FOR MIRROR-POLISHING OF WORKPIECE EDGES

FIELD OF THE INVENTION

The present invention relates to a method and apparatus for mirror-polishing chamfered edges along the outer circumference of disc-shaped workpieces, such as a semiconductor wafers or magnetic discs.

PRIOR ART

For example, a semiconductor wafer, such as a silicon workpiece, may have its periphery chamfered to prevent its edges from chipping or crowning during epitaxial growth. In the prior art, the semiconductor wafer is often chamfered by grinding it using a diamond grindstone. By this method, however, a distorted layer is likely to remain after grinding, resulting in crystal defects when thermal treatment is repeated during the following manufacturing process.

For this reason, the distorted layer is normally removed by etching. Unfortunately, the etched surface often forms wavy or flaky recesses and protrusions on which stains are likely to remain. Such stains are diffused throughout a wafer during the following manufacturing process and play a major role in performance degradation.

In recent years, techniques for smoothing the chamfered edges of a wafer using mirror-polishing have been established independently of wafer surface polishing. The applicant has also proposed a technique for polishing wafer edges, as disclosed in Japanese Patent Application Laid Open No. 1-71656. This polishing technique rotates a wafer having chamfered edges on its outer circumference while pressing the outer circumferential edges against the work surfaces of the outer circumferences of rotating polishing drums in order to enable the edges of the wafer to be polished easily and reliably, thereby solving all the problems caused by chamfering.

Such a polishing apparatus, however, point-contacts the wafer with the polishing drums, so processing efficiency is not always high and a relatively large amount of time is required for processing. To reduce the processing time, attempts have been made to increase the diameter of the polishing drums and thus the contact length between the wafer and the polishing drums.

When using the method for externally contacting a circular wafer with cylindrical work surfaces, however, there is a limit to the extent to which the contact length can be increased, and consequently, processing time cannot be significantly reduced. In addition, increasing the diameter of the polishing drums necessitates a corresponding increase in installation space, thereby inevitably requiring the size of the apparatus to be increased as well. In the future, wafers are likely to be as large as 30 to 40 cm in diameter. As the space occupied by the wafer will substantially increase, the polishing apparatus will have to be even larger.

PROBLEMS TO BE SOLVED BY THE INVENTION

It is an object of this invention to provide a small polishing means that has a high processing efficiency and that can mirror-polish the outer circumferential edge of a workpiece efficiently and promptly at a plurality of points.

MEANS FOR SOLVING THE PROBLEMS

To achieve this object, this invention arranges, at an interval smaller than the diameter of a workpiece, a plurality of cylindrical polishing drums whose outer circumferential surfaces are used as work surfaces for polishing. The invention rotates the polishing drums at the desired speed to contact a disc-shaped workpiece having chamfered outer-circumferential edges with the work surfaces of the polishing drums at the same time in order to polish the outer circumferential edges of the front and rear planes of the workpiece at a number of points.

According to this invention, the outer circumferential edges of the workpiece are polished at a plurality of points to improve the polishing efficiency and to reduce the polishing time. In addition, this invention not only enables the use of polishing drums whose diameter is far smaller than in the prior art, but also allows polishing to be executed while the tip of the workpiece is fitted in the space between the adjacent polishing drums. Consequently, only a very small space is occupied by the polishing drums and workpiece, and so the size of the apparatus can be substantially reduced.

One specific embodiment of this invention comprises two polishing drums; a first and a second workpiece holding means; and a means for turning a workpiece upside down, wherein the front-plane edge of the workpiece is pressed by a first workpiece holding means against the work surfaces of the two polishing drums on their first side, whereas the rear-plane edge of the workpiece is pressed by a second workpiece holding means against the work surfaces of the two polishing drums on their second side.

According to this invention, the two polishing drums are preferably tilted in a direction in which their tips approach each other, thereby enabling both polishing drums to perpendicularly contact conical surface-like edges.

According to this invention, the polishing drums and the workpiece holding means can preferably be displaced relative to the position at which the workpiece contacts the work surfaces, in order to change that position and prevent the work surfaces from being partially worn.

According to a preferable embodiment of this invention, the workpiece holding means comprises an urging means that causes the workpiece to contact the work surfaces at a specified pressure during processing; and an alignment means that realigns the workpiece relative to the two polishing drums so as to ensure uniform contact between the workpiece and the two polishing drums.

Another embodiment of this invention includes three polishing drums arranged in a triangle and three workpiece holding means disposed around the polishing drums such that each is located between the two adjacent polishing drums.

Still another embodiment of this invention includes four polishing drums arranged in a rectangle and four workpiece holding means disposed around the polishing drums such that each is located between the two adjacent polishing drums.

DETAILED DESCRIPTION OF THE INVENTION

DETAILED DESCRIPTION OF THE INVENTION

Figure 1:
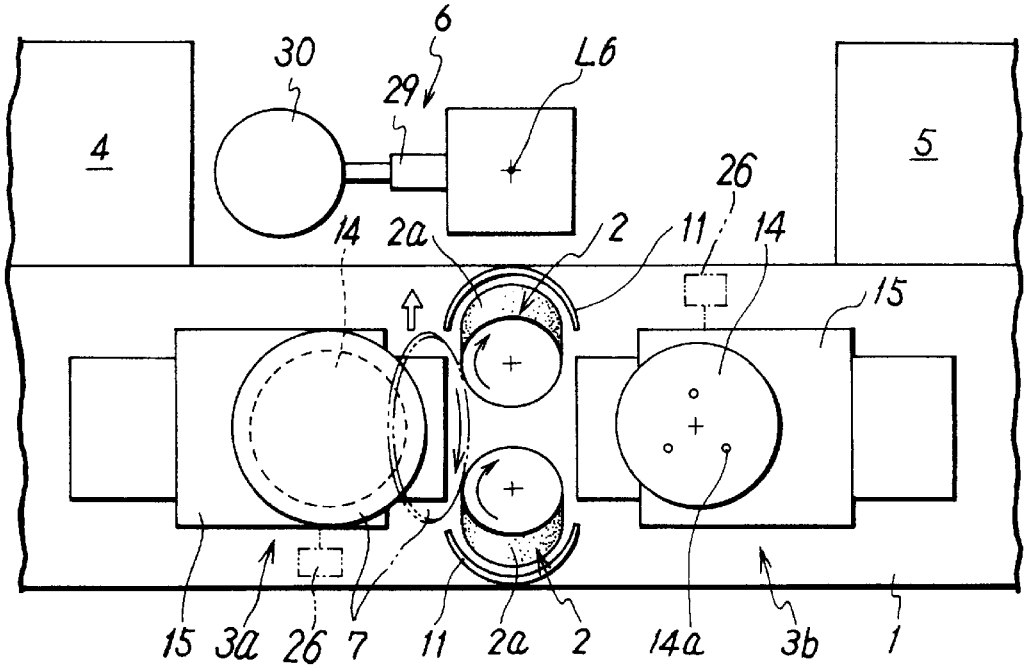
FIG. 1 is a top view showing a first embodiment of a polishing apparatus according to this invention.
Figure 2:
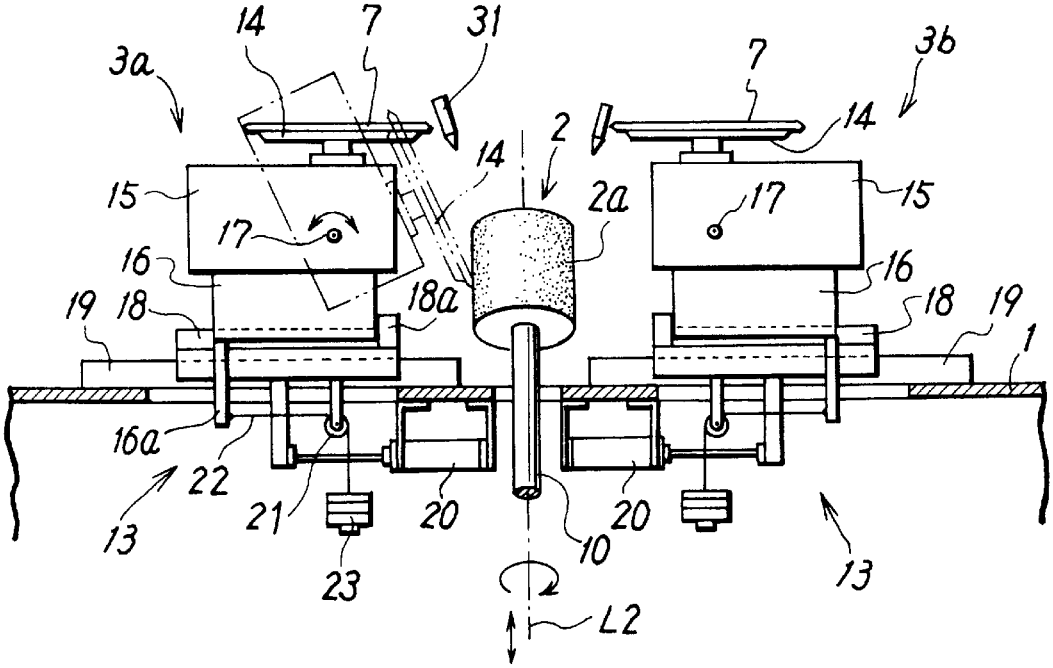
FIG. 2 is a partly exploded front view of FIG. 1.

FIGS. 1 and 2 show a first embodiment of a polishing apparatus according to this invention. This polishing apparatus has a main body 1; two cylindrical polishing drums 2 and 2 which are arranged in parallel on the main body 1; a first and a second workpiece holding means 3*a* and 3*b* disposed on a first and a second sides, respectively, around the polishing drums 2 and 2; a loading section 4 provided on one side of the main body 1 for loading an unprocessed workpiece; an unloading section 5 provided on the other side of the main body 1 for unloading a processed workpiece; and a workpiece transfer means 6 for chucking a workpiece for transfer.

The outer circumferential surfaces of the polishing drums 2 and 2 are formed as a work surface 2*a* for polishing by adhering a polishing pad to the outer surface of a base cylinder. The two polishing drums 2 and 2 of the same configuration are disposed in such a way as to be tilted in a direction in which their tips approach each other with a gap smaller than the diameter of a workpiece 7 maintained there between and in such a way that the drums can each rotate around their own axis L2. Drum shafts 10 of the polishing drums 2 and 2 are connected to a driving source such as a motor and are driven in the same direction or different directions at the same speed or different speeds (for example, 500 to 1,000 rpm). The drum shaft 10 is supported by the main body 1 in such a way as to be moved back and forth in the direction of the axis L2 and is connected to an oscillating means (not shown) consisting of a ball screw and a nut member that is screwed around it so that each polishing drum 2 and 2 can synchronously oscillate in the direction of the axis at a low speed during processing. The oscillating directions of the polishing drums may be the same or different, for example, while one of them may be moving forward, the other may be moving backward.

Figure 3:
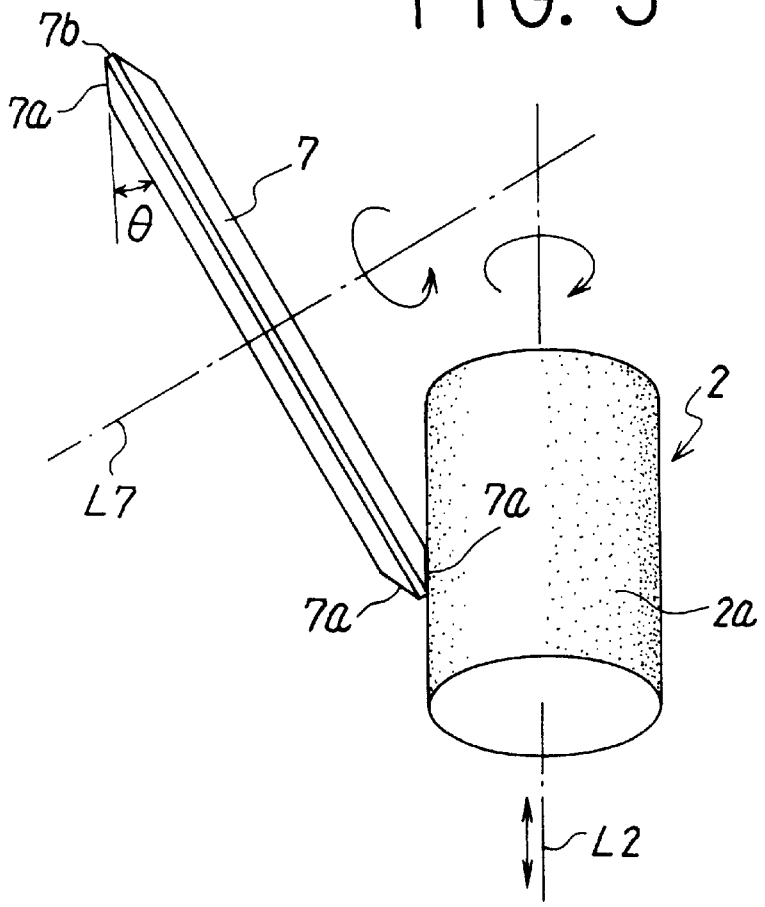
FIG. 3 is an enlarged schematic view of the workpiece edges in FIG. 2 when they are polished.
Figure 4:
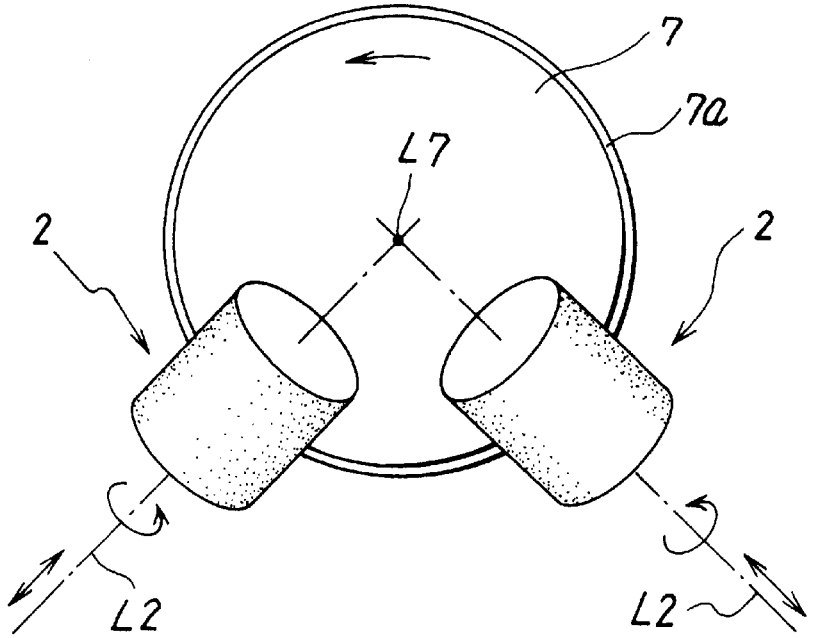
FIG. 4 shows the workpiece in FIG. 3 as seen from the axial direction.

As can be seen in FIGS. 3 and 4, the two polishing drums 2 and 2 are tilted at the same angle as that at which their axis L2 crosses the central axis L7 of the workpiece 7 that is polished while being tilted forward. This configuration allows both polishing drums 2 and 2 to contact an edge 7*a* shaped like a conical surface that runs per peudicularly along the total width of the workpiece. If, however, the gap between the two polishing drums 2 and 2 is small and they can be contacted together almost perpendicularly to the edge along the total width of the workpiece, the polishing drums may be installed in parallel without being tilted.

In the figures, 11 is a cover that prevents the washing liquid from splashing during processing.

The first and second workpiece holding means 3*a* and 3*b* hold the disc-shaped workpiece 7 (see FIG. 3), which is chamfered at an angle θ and has outer circumferential edges 7*a* and 7*b* on its front and rear planes. The workpiece holding means 3*a* and 3*b* rotate the workpiece 7 around the axis L7. The workpiece holding means also simultaneously contact either of the edges 7*a* of the workpiece with the work surfaces 2*a* and 2*a* of the polishing drums 2 and 2 and have the same configuration.

The workpiece holding means 3*a* and 3*b* each have a chuck head 14 that vacuum-chucks the workpiece 7; a first body 15 that rotatably holds the chuck head 14; a second body 16 that supports the first body 15 in such a way as to be tilted around a supporting shaft 17; and a supporting mechanism 13 for supporting the second body 16 in such a way as to move linearly towards and away from the polishing drums 2 and 2. The supporting mechanism 13 has a slide table 18 on which the second body 16 can be placed and slid back and forth, and the slide table 18 is supported on the main body 1 in such a way as to move linearly towards and away from the polishing drums 2 and 2 along a rail 19, and is moved by a driving means such as a cylinder 20.

The chuck head 14 has in its surface a plurality of suction holes 14*a* that are connected to a vacuum source via ports provided in the first and second bodies 15 and 16 or tubes (not shown). The chuck head 14 is connected to a motor provided in the first body 15, and is driven at a slow speed while the edge is being polished; for example, it may rotate once every 40 to 60 seconds.

In addition, the first body 15 can tilt anywhere between a standby position at which the chuck head 14 faces horizontally to separate the workpiece 7 from the polishing drums 2 and 2, as shown by the continuous line in FIG. 2, and a processing position at which the chuck head 14 is tilted to contact the edge 7*a* of the workpiece with the two polishing drums 2 and 2, as shown by the chain line in FIG. 2. Actually, at the standby position, the workpiece holding means 3*a* and 3*b* are moved by the cylinder 20 slightly further from the polishing drums 2 and 2.

On the other hand, one end of a wire 22 that passes around a pulley 21 on the slide table 18 is fixed to an arm 16*a* extending from the second body 16, and a weight 23 is hung from the tip of the wire 22 so that the weight 23 urges the second body 16 toward the polishing drums 2 and 2 under a constant force. The weight 23 constitutes a means by which to ensure that the workpiece 7 presses against the polishing drums 2 and 2 at a constant contact pressure during polishing. While the edge 7*a* is not being polished, the second body 16 engages a stopper 18*a* at the front end of the slide table 18 so as not to advance further, as shown in FIG. 2.

At the tip of a telescopic chuck arm 29 that can be swivelled around an axis L6 and that can be turned upside down, the workpiece transfer means 6 has a chuck head 30 that vacuum-chucks the workpiece 7. In this way, the chuck head 30 can supply an unprocessed workpiece from the loading section 4 to the chuck head 14 of the first workpiece holding means 3*a*; turn the workpiece 7 from the first workpiece holding means 3*a* upside down when front-plane edge 7*a* of the workpiece has been polished and transfer the work piece to the second workpiece holding means 3*b*; and transfer the workpiece 7 from the second workpiece holding means 3*b* to the unloading section 5 when the rear-plane edge 7*a* of the workpiece has been polished.

In the figure, 31 is a nozzle that supplies polishing slurry to a polished part.

In a polishing apparatus having the above configuration, when the workpiece transfer means 6 supplies an unprocessed workpiece from the loading section 4 to the chuck head 14 of the first workpiece holding means 3*a*, which is at its standby position, the first body 15 is tilted forward around the supporting shaft 17 through an angle determined by the chamfering angle θ ( of the edge 7*a*, as shown by the chain line in FIG. 2. The operation of the cylinder 20 causes the slide table 18 to advance along the rail 19 toward the polishing drums 2 and 2, thereby causing the front-plane edge 7*a* of the workpiece 7, which is being rotated while being held by the chuck head 14, to be pressed against the work surfaces 2*a* and 2*a* on the outer circumferences of the two rotating polishing drums 2 and 2 on their first side for polishing.

The contact pressure of the workpiece 7 on the working surface 2*a* is obtained by the force of the weight 23. Before the slide table 18 that is moved by the cylinder 20 reaches the end of its stroke, the workpiece 7 abuts the polishing drums 2 and 2 to stop the second body 16 at that position. The slide table 18, however, continues to move over a specified distance, so the weight 23 applies a force via the second body 16 to ensure that the workpiece 7 presses against the polishing drums 2 and 2 at a constant pressure during processing.

Figure 5:
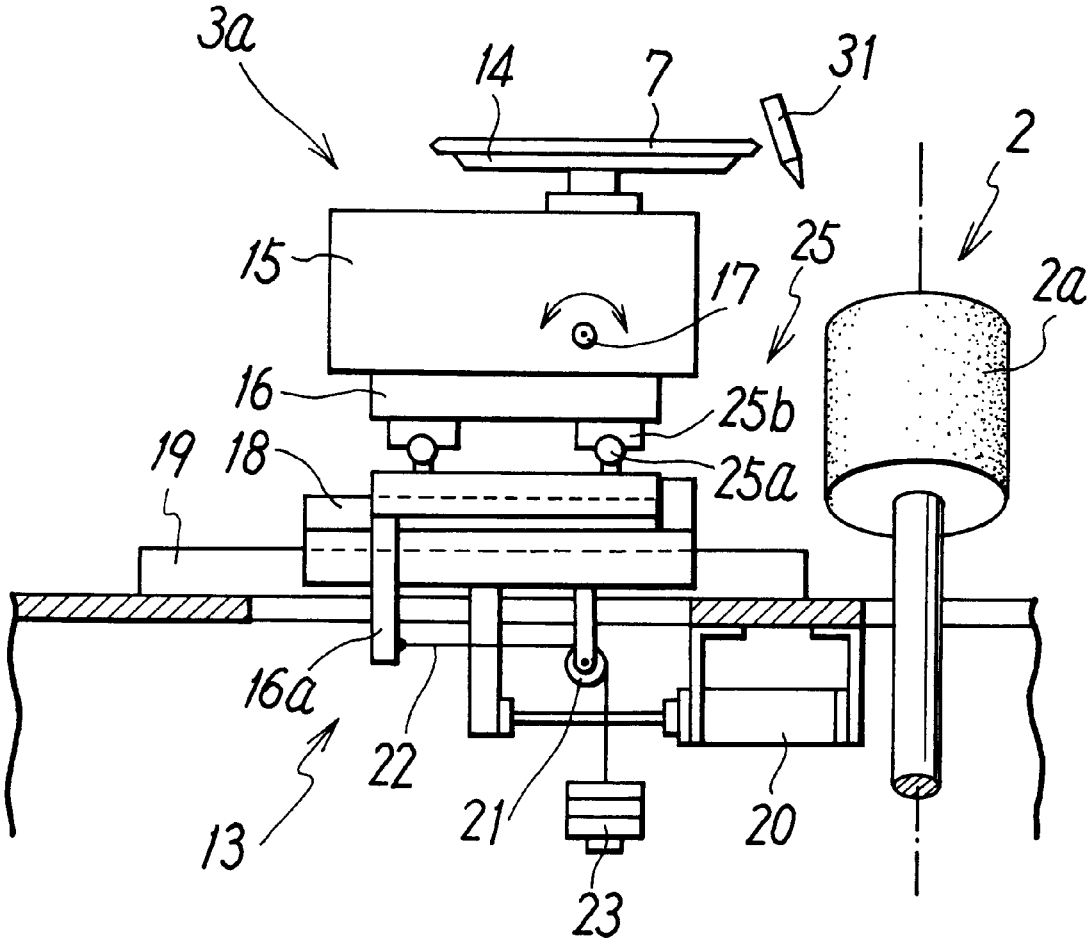
FIG. 5 is a schematic sectional view showing an example of an aligning mechanism.

It is preferable for the workpiece holding means 3*a* and 3*b* to each have an alignment means for correcting the misalignment of the workpiece 7 so that it evenly contact the two polishing drums 2 and 2. This prevents the workpiece from being biased towards one of the polishing drums 2 and pressing too hard against one of the work surfaces 2*a*. The alignment means must allow the chuck head 14 to freely move parallel to the axis of the supporting shaft 17. In other words, the direction must be parallel with the line joining the centers of the two polishing drums. However, the alignment means may allow the entire workpiece holding means 3*a* and 3*b* to be moved in the above direction, as shown in FIG. 5. In this figure, a linear-guide-type second supporting mechanism 25 consisting of a guide rail 25*a* and a slider 25*b*, which can slide linearly along the rail, is provided between the second body 16 and the supporting mechanism 13. This second supporting mechanism 25 supports the workpiece holding means 3*a* and 3*b* in such a way as to be moved between the two polishing drums 2 and 2.

If only the second supporting mechanism 25 is provided, however, if the rotating workpiece 7 contacts the two polishing drums 3*a* and 3*b*, as shown in FIG. 1, a tangential force may be imparted on the workpiece 7 due to the frictional force between the workpiece and the drums, causing the workpiece holding means 3*a* and 3*b* to be misaligned along the second supporting mechanism 25 toward one of the polishing drums. Thus, a second urging means 26 for canceling the acting force is preferably provided for the workpiece holding means 3*a* and 3*b*, as shown by the chain line in FIG. 1. Like the first urging means, the second urging means 26 can be most simply composed of a weight that may be mounted on one of the sides of each of the workpiece holding means 3*a* and 3*b* in such a way as to cancel the tangential force imparted.

Thus, the front-plane edges 7*a* of the workpiece 7 evenly contact the work surfaces 2*a* and 2*a* of the two polishing drums 2 and 2 simultaneously, and are thus mirror-polished at two different points. During polishing, the two polishing drums 2 and 2 slowly oscillate back and forth in the direction of the axis L2 so as to change the position at which they contact the workpiece.

Once the front-plane edges 7*a* of the workpiece 7 have been completely polished, the workpiece holding means 3*a* is moved backward by the cylinder 20 to cause the workpiece 7 to leave the polishing drums 2 and 2, while the first body 15 returns to its standby position to face the workpiece 7 in the horizontal direction.

Next, the workpiece transfer means 6 receives the workpiece 7 from the first workpiece holding means 3*a*, turns it upside down, and supplies it to the second workpiece holding means 3*b*, which polishes the rear-plane edge 7*a* on the other side of the two polishing drums 2 and 2, just as was done when polishing the front-plane edge.

The work surfaces 2*a* and 2*a* of the polishing drums 2 and 2 should be flexible enough to allow the outer circumferential surface 7*b* of the workpiece to cut into the work surface 2*a* over at least half the width of the drum when polishing the edge 7*a*. So that the outer circumferential surface 7*b* can be polished, just as was done when polishing the front- and rear-plane edges 7*a* and 7*a*.

Once the rear-plane edge 7*a* has been polished, the second workpiece holding means moves to its standby position, and the workpiece transfer means 6 receives the workpiece 7 from the second workpiece holding means 3*b* and transfers it to the unloading section 4.

Polishing of the front-plane edge 7*a* by the first workpiece holding means 3*a* and of the rear-plane edge 7*a* by the second workpiece holding means 3*b* is performed synchronously during an automated process. Accordingly, the workpiece transfer means 6 must sequentially time the transfer of workpieces 7 to accommodate these polishing steps.

Although, in the above embodiment, the means for setting the contact pressure of the workpiece 7 during polishing consists of the weight 23, an air cylinder with a pressure regulating means can be used instead.

In addition, although the illustrated polishing apparatus is shown to have only one set of polishing means, including the two polishing drums 2 and 2 and the two workpiece holding means 3*a* and 3*b*, an actual polishing apparatus may have a plurality of polishing means by, for example, providing another set of polishing means opposite to the first set of polishing means across the workpiece transfer means 6.

Furthermore, although the illustrated embodiment arranges the two polishing drums 2 and 2 and the chuck head 14 in such a way that their axes are vertical, they may be installed in such a way that their axes are horizontal. That is, as if FIG. 1 is assumed to be a front view, the two polishing drums 2 and 2 may be placed in such a way that each drum is aligned up and down horizontally and the chuck head 14 is likewise aligned horizontally while the workpiece 7 is held vertically during the polishing operation.

Furthermore, the workpiece holding means is only provided on either the first or second side of the two polishing drums 2 and 2, as required, so that one workpiece holding means turns the workpiece upside down to polish the front-surface and rear-surface edges of the workpiece.

Figure 6:
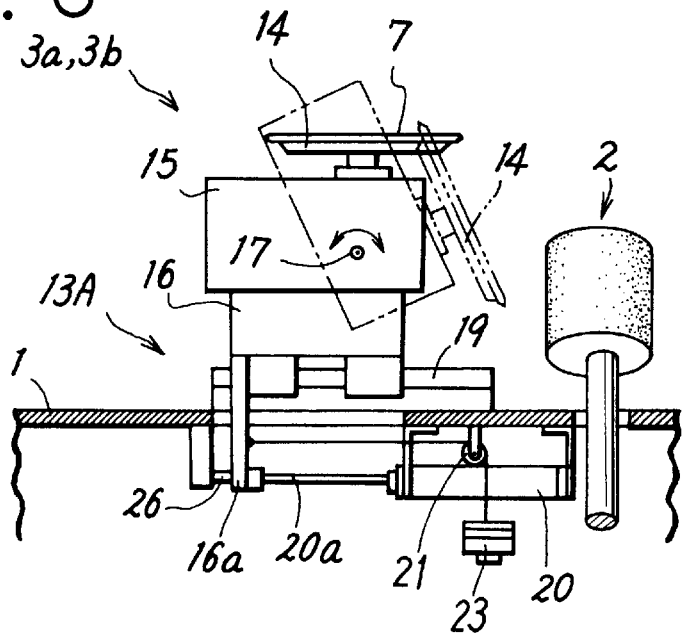
FIG. 6 is a schematic sectional view showing an example of a supporting mechanism having a different structure that movably supports the workpiece holding means.

FIG. 6 shows a different example of a supporting mechanism for movably supporting the workpiece holding means 3*a* and 3*b* on the main body 1. In a supporting mechanism 13A, the second body 16 is placed directly on a rail 19 and slid along it, the pulley 21 is mounted on the main body 1, and the arm 16*a* of the second body 16 is pushed by a rod 20*a* of the air cylinder 20 in the same direction as that in which the arm separates from the polishing drums 2 and 2. In the figure, 26 is a stopper that causes the second body 16 to stop at its standby position.

In the supporting mechanism 13A, while the edge is being polished, when the rod 20*a* of the air cylinder 20 withdraws from the illustrated standby position, the gravity of the weight 23 causes the second body 16 to move the second body 16 along the rail 19 in the same direction as that in which the second body 16 approaches the polishing drums 2 and 2. The second body stops at a position at which the workpiece 7 abuts the polishing drums 2 and 2, but the rod 20*a* is slightly withdraws from the arm 16*a*, causing the workpiece 7 to be pressed against the polishing drums 2 and 2 due to the force of the weight 23.

Figure 7:
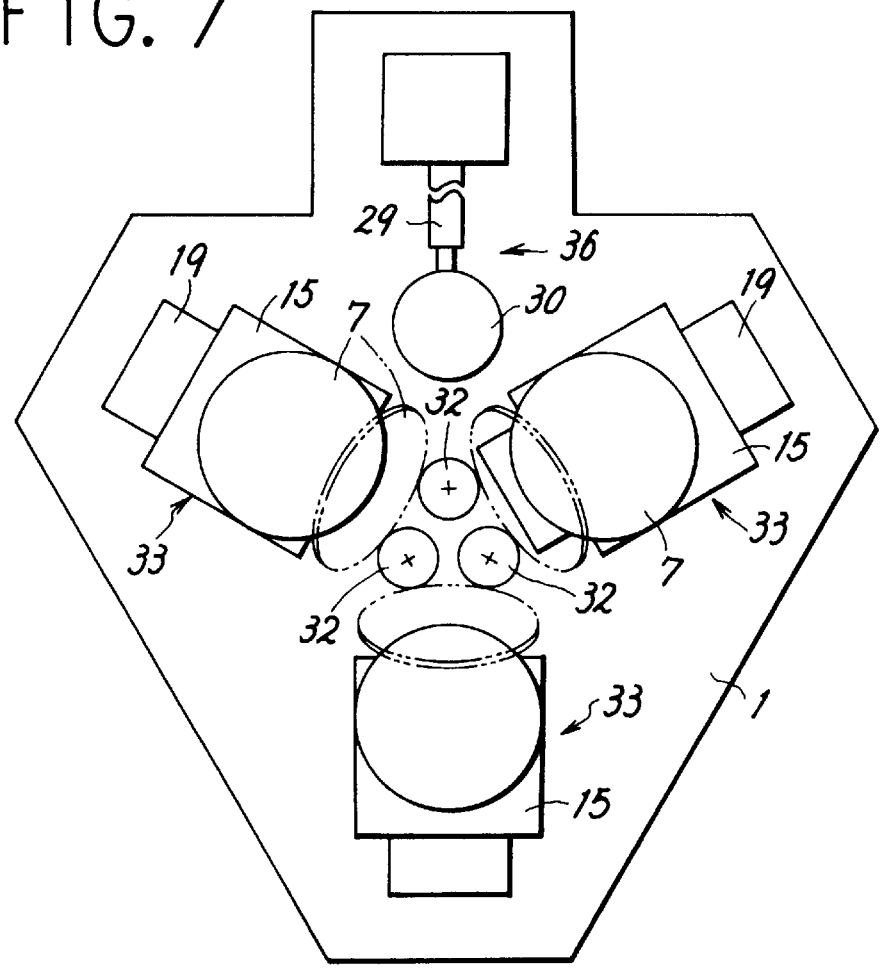
FIG. 7 is a top view showing a second embodiment of a polishing apparatus according to this invention.

FIG. 7 shows a second embodiment of the invention. A polishing apparatus according to the second embodiment has three polishing drums 32 disposed at the vertices of a triangle; three workpiece holding means 33 disposed in such a way that each of them is located between the two adjacent polishing drums 32 and 32; and a workpiece transfer means 36 for supplying and discharging the workpiece 7 to and from the workpiece holding means 33 and turning the workpiece upside down. The three workpiece holding means 33 contact the front-plane edge of the workpiece 7 with the two adjacent polishing drums 32 and 32, polish the workpiece, and then turn it upside down to contact the rear-plane edge with the two polishing drums 32 and 32 to resume polishing.

The configurations of the workpiece holding means 33 and workpiece transfer means 36 are substantially the same as those in the first embodiment, so the required components have been given the same reference numerals as in the first embodiment, and specific descriptions of them are omitted. Likewise, the loading and unloading sections are omitted FROM THE DISCUSSION.

During the polishing operation, because the second embodiment can contact the edges of the three workpieces 7 with the corresponding polishing drums 32 simultaneously at more than one point, the apparatus of this embodiment has a very high polishing efficiency.

Figure 8:
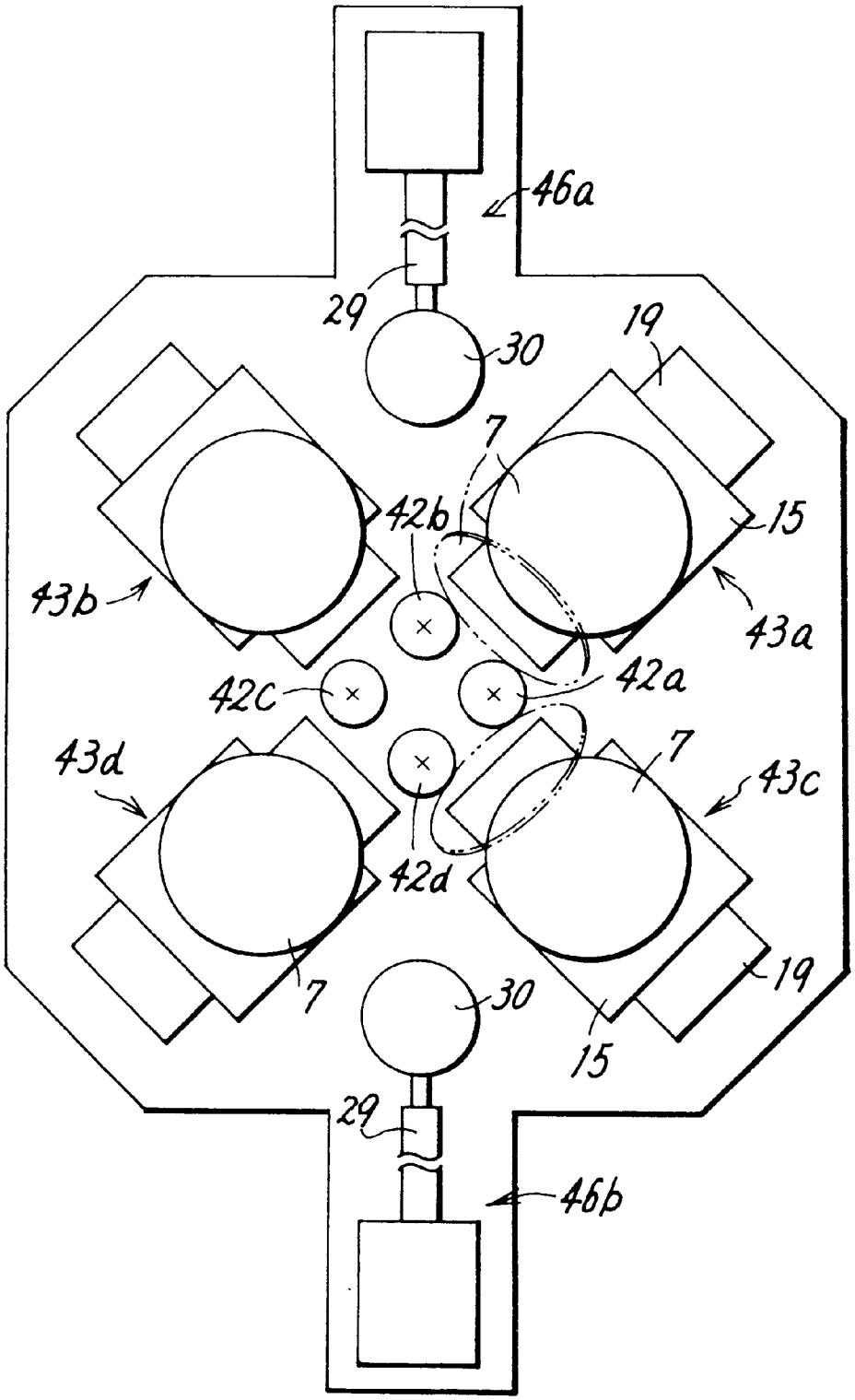
FIG. 8 is a top view showing a third embodiment of a polishing apparatus according to this invention.

FIG. 8 is a third embodiment of this invention. A polishing apparatus according to the third embodiment has four polishing drums 42*a* to 42*d* disposed in such a way as to be located at the vertices of a rectangle; four workpiece holding means 43*a* to 43*d* disposed between the two nearest polishing drums; and two workpiece transfer means 46*a* and 46*b* for supplying and discharging the workpiece to and from the workpiece holding means and turning it upside down.

Of the four workpiece holding means, the first and third workpiece holding means 43*a* and 43*c* cause the front-plane edge of the workpiece 7 to contact the two polishing drums 42*a*, 42*b* and 42*a*, 42*d*, respectively, for polishing. The second and fourth workpiece holding means 43*b* and 43*d* contact with the two polishing drums 42*b*, 42*c* and 42*c*, 42*d*, the rear-plane edge of the workpiece 7 the front-plane edge of which has been polished by the first and third workpiece holding means 43*a* and 43*c*, respectively, for polishing.

The first workpiece transfer means 46*a* is disposed between the first workpiece holding means 43*a* and the second workpiece holding means 43*b*, and the second workpiece transfer means 46*b* is disposed between the third workpiece holding means 43*c* and the fourth workpiece holding means 43*d*.

The configurations of the workpiece holding means 42*a* to 42*d* and workpiece transfer means 46*a* and 46*b* are substantially the same as those in the first embodiment, so the required components have been assigned the same reference numerals as in the first embodiment, and their descriptions have been omitted. Likewise, the loading and unloading sections are not described.

In addition, the first and third workpiece holding means 43*a* and 43*c* used to polish the front-plane edge are adjacent to each other, and the second and fourth workpiece holding means 43*b* and 43*d* used to polish the rear-plane edge are also adjacent to each other, but each pair of workpiece holding means may be placed opposite each other.

Since the third embodiment is substantially the same as the first embodiment except for the two sets of polishing means, it can polish a workpiece with twice the efficiency of the first embodiment.

As described above, this invention can contact the edge of the workpiece with several polishing drums simultaneously, and thus mirror-polish the edge of the workpiece at several points at the same time, thereby improving polishing efficiency and significantly reducing polishing time.

In addition, this invention can not only use polishing drums of a diameter substantially smaller than in the prior art, but also polish the workpiece with its tip fitted between adjacent polishing drums. Consequently, the space occupied by the polishing drums and workpiece during polishing is very small, and the size of the apparatus is significantly reduced.

What is claimed is:

1. A workpiece edge mirror-polishing method for polishing a disc-shaped workpiece having an outside diameter, front and rear planes and chamfered outer circumferential edges on said front and rear planes, said method comprising the following steps:

rotating at a desired speed a plurality of cylindrical polishing drums having outer circumferences and having work surfaces on said outer circumferences wherein said polishing drums are located at an interval smaller than the diameter of said workpiece;

rotating at a desired speed said workpiece while contacting said circumferential edge on said front plane with the work surfaces on the outer circumferences of the plurality of said polishing drums at the same time for polishing;

turning said workpiece upside down; and rotating at a desired speed the workpiece that has been turned upside down while contacting said circumferential edge on said rear plane with the work surfaces of the plurality of polishing drums at the same time for polishing.

2. A polishing method according to claim 1 wherein two polishing drums each having a first side and a second side are provided so that said circumferential edge on said front plane of said workpiece is polished on said first side of the two polishing drums while said circumferential edge on said rear plane is polished on said second side of said polishing drums.

3. A polishing method according to claim 2 wherein said polishing drums and workpiece are moved relative to each other to change from a first position in which the workpiece contacts the work surfaces to a second position in which the workpiece contacts the work surfaces.

4. A polishing method according to claim 1 wherein said polishing drums and said workpiece are moved relative to each other to change from a first position in which the workpiece contacts the work surfaces to a second position in which the workpiece contacts the work surfaces.

5. An apparatus for mirror-polishing the edges of a disc-shaped workpiece having an outside diameter, front and rear planes and chamfered outer circumferential edges on said front and rear planes, wherein said apparatus comprises:

a plurality of cylindrical polishing drums having outer circumferences and having a polishing work surface on their respective outer circumferences, wherein said polishing drums are rotatably disposed at an interval smaller than the diameter of said workpiece, such that the polishing drums mirror-polish the outer circumferential edge of the workpiece at a plurality of different points;

means for rotating said polishing drums;

one or more workpiece holding means for holding and rotating at a desired speed said workpiece while contacting the outer circumferential edge of said front plane or said rear plane of the workpiece with the work surfaces of the plurality of polishing drums; and means for turning said workpiece upside down.

6. A polishing apparatus according to claim 5 wherein two polishing drums each having a first side and a second side are provided, wherein a first and a second workpiece holding means are provided adjacent the polishing drums so that said first workpiece holding means presses the outer circumferential edge of said front plane of the workpiece against said two polishing drums on the first side while said second workpiece holding means presses the outer circumferential edge of said rear plane of the workpiece against said two polishing drums on the second side.

7. A polishing apparatus according to claim 6 wherein said two polishing drums are tilted so that their tips approach each other.

8. A polishing method according to claim 7 wherein said polishing drums and workpiece are moved relative to each other to change from a first position in which the workpiece contacts the work surfaces to a second position in which the workpiece contacts the work surfaces.

9. A polishing apparatus according to claim 6 wherein said workpiece holding means has an urging means for constantly contacting the workpiece with the work surfaces under a specified pressure during polishing and an alignment means for correcting misalignment of the workpiece relative to the two polishing drums to allow the workpiece to evenly contact both polishing drums.

10. A polishing apparatus according to claim 9 wherein said urging means is formed of a weight mounted on said workpiece holding means to apply a constant processing pressure to the workpiece due to the force of gravity, wherein the alignment means consists of a supporting mechanism for movably supporting said workpiece holding means between two polishing drums; and a second urging means for using contact between the rotating workpiece and the two polishing drums to absorb any force that might cause the workpiece to be misaligned.

11. A polishing apparatus according to claim 10 wherein said second urging means is a weight.

12. A polishing method according to claim 6 wherein said polishing drums and workpiece are moved relative to each other to change from a first position in which the workpiece contacts the work surfaces to a second position in which the workpiece contacts the work surfaces.

13. A polishing apparatus according to 5 wherein said polishing drums and said workpiece holding means are moved relative to each other to change from a first position in which the workpiece contacts the work surfaces to a second position in which the workpiece contacts the work surfaces.

14. A polishing apparatus according to claim 5 wherein three polishing drums are provided in such a way as to form a triangle and wherein three workpiece holding means are disposed around the polishing drums in such a way that each of them is located between two adjacent polishing drums.

15. A polishing apparatus according to claim 5 wherein four polishing drums are provided in such a way as to form a rectangle and wherein four workpiece holding means are disposed around the polishing drums in such a way that each of them is located between two adjacent polishing drums.

* * * * *